US008022339B2

(12) United States Patent
Schlipf

(10) Patent No.: US 8,022,339 B2
(45) Date of Patent: Sep. 20, 2011

(54) ELECTRIC CARTRIDGE TYPE HEATER

(75) Inventor: Andreas Schlipf, Tuttlingen (DE)

(73) Assignee: Türk + Hillinger GmbH, Tuttlingen (DE)

( * ) Notice: Subject to any disclaimer, the term of this patent is extended or adjusted under 35 U.S.C. 154(b) by 960 days.

(21) Appl. No.: 11/942,942

(22) Filed: Nov. 20, 2007

(65) Prior Publication Data

US 2009/0032519 A1 Feb. 5, 2009

(30) Foreign Application Priority Data

Aug. 3, 2007 (DE) ..... 20 2007 010 865 U

(51) Int. Cl.
*H05B 3/18* (2006.01)
*H05B 3/06* (2006.01)
*H05B 3/44* (2006.01)
*H05B 3/10* (2006.01)

(52) U.S. Cl. ..... 219/535; 219/542; 219/544

(58) Field of Classification Search ..... 219/535, 219/541, 544, 549; 338/302, 238, 239, 241
See application file for complete search history.

(56) References Cited

U.S. PATENT DOCUMENTS 3,310,769 A * 3/1967 Simmons ..... 338/241
3,881,163 A * 4/1975 Lindroth et al. ..... 338/302
5,136,141 A 8/1992 Trakas
5,704,113 A * 1/1998 Mak ..... 29/611
6,683,283 B2 * 1/2004 Schmidt ..... 219/424
7,034,258 B2 * 4/2006 Sutorius ..... 219/535
2003/0209532 A1 11/2003 Schmidt
2003/0218006 A1 * 11/2003 Sutorius ..... 219/535

FOREIGN PATENT DOCUMENTS

DE 295 01 450 U1 3/1995
DE 195 14 487 A1 6/1996
DE 199 43 192 A1 4/2001
DE 103 33 206 A1 4/2004

* cited by examiner

*Primary Examiner* — Geoffrey S Evans
*Assistant Examiner* — Vinod Patel
(74) *Attorney, Agent, or Firm* — McGlew and Tuttle, P.C.

(57) ABSTRACT

The electric cartridge type heater has a continuous central fitting hole (2) for receiving a cylindrical body to be healed in a gap-free manner, an inner metal jacket (1), an outer metal jacket (3) and a healing conductor wound on the circumference of a coil form (8), which is inserted in an annular chamber (4). The coil form has a cylinder wall with holes (10) or ducts (11/1) for receiving ends (12, 13, 15, 16) of the heating wire winding (9). The connecting conductors (18, 19) are led radially to the outside through an opening (20, 20/1) of the outer metal jacket (3) in an axial area which is located away from the two axial ends of the annular chamber (4) and is located between two heating wire windings (9/1, 9/2) or two winding sections (9*a*, 9*b*) of the same heating wire winding (9).

25 Claims, 8 Drawing Sheets

ELECTRIC CARTRIDGE TYPE HEATER

CROSS REFERENCE TO RELATED APPLICATIONS

This application claims the benefit of priority under 35 U.S.C. §119 of German Patent Application DE 20 2007 010 865.6 filed Aug. 3, 2007, the entire contents of which are incorporated herein by reference.

FIELD OF THE INVENTION

The present invention pertains to an electric cartridge type heater with a continuous central fitting hole for receiving a cylindrical body to be heated, especially a plastic injection molding nozzle, in a gap-free manner, with an inner metal jacket and an outer metal jacket and with at least one heating conductor, which is wound as a heating wire winding on the circumference of a hollow cylindrical coil form, which is inserted in an annular chamber located between the inner and outer metal jackets, is closed on the front side, is surrounded by an insulating compound and consists of a ceramic mass or a metal oxide and whose cylinder wall has axially parallel holes or ducts for receiving the ends of the heating wire winding and optionally the electric connecting conductors connected to the ends of the heating wire winding, wherein all parts are compacted by radial pressing.

BACKGROUND OF THE INVENTION

An electric cartridge type heater of the type of this class is known, for example, from DE 103 33 206 A1.

Contrary to other cartridge type heaters, which are used for the same purpose, for example, for heating a plastic injection molding nozzle, the cartridge type heaters of this class have the advantage that they can provide a sufficiently long heating wire length for the needed heating capacity with a very small wall thickness of the cylindrical cartridge wall in the compacted state and that they also offer the possibility of providing a heating capacity distribution over the length of the cartridge type heater by selecting different distances between windings in certain axial areas.

While the electric terminals usually exit from the cylindrical cartridge body on the front side in these prior-art cartridge type heaters, it is required in more recent injection molds, especially in molds with a plurality of cavities, that the electric terminals shall not be arranged on one of the front sides of the cartridge type heater, but somewhere on the circumference.

Even though there already are heating devices for plastic injection molding nozzles with terminals that are arranged radially or tangentially in the middle of the heating body, these heating devices are wound tubular heating elements, which have a completely different design and are also not comparable to the cartridge type heater of this class in terms of capacity.

SUMMARY OF THE INVENTION

The basic object of the present invention is to provide a cartridge type heater of the type described in the introduction with improved possibilities of use, in which especially the electric connecting conductors are not arranged at a front-side end of the cartridge body but at a point on the circumference at which they are more readily accessible during installation.

This object is accomplished according to the present invention such that the connecting conductors connected to the ends of the at least one heating wire winding and/or the ends of the at least one heating wire winding are led radially outward through an opening of the outer metal jacket in an axial area located away from the two axial ends of the annular chamber and located between two heating wire windings or two winding sections of the same heating wire winding.

Due to the cartridge type heater being designed according to the present invention, the user has substantially better possibilities concerning the installation of the cartridge type heater in a predetermined injection mold because he is not limited to leading the electric terminals to a front side of the cartridge type heater. The provision of an opening in the outer metal jacket, through which opening the ends of the heating wire winding and/or the connecting conductors thereof can be led to the outside and directed in any desired direction, makes it possible to design the electric terminals very variably and hence also to optimize the possibilities of installation of the cartridge type heater in an injection mold. In addition, it is, of course, possible to place the opening of the outer metal jacket such that it is optimally coordinated for the user or for the particularly intended installation and the possibilities of connection that are provided for in the particular case.

While it is possible, in principle, to lead to ends of the windings or the connecting conductors connected to the winding ends to the opening of the outer metal jacket radially outside the heating wire winding present, the design offers the considerable advantage that the connecting conductors connected to the winding ends can be led directly radially to the outside in the area of the opening of the outer metal jacket from a hole or a duct of the winding support, so that overlaps with the heating wire windings located on the winding support can be avoided.

Different covers may be provided for the opening in the outer metal jacket, and these covers offer a certain protection for the connecting conductors led to the outside, especially if these are not led to the outside radially but are bent off. In addition, the opening in the outer metal jacket can be tightly closed, so that the cavity that is otherwise present can be filled with an insulating compound or a pourable sealing compound in the area of this opening as well.

The opening in the form of an annular gap has, moreover, the advantage that the winding support or the winding supports can be pushed in any rotation position onto the inner metal jacket or into the outer metal jacket, so that the connecting conductors can be led out of the annular gap in any circumferential position.

Various possibilities are available for sealing this gap towards the outside and for providing possibilities for exiting for the connecting conductors. These possibilities include a ring wall and ring disks.

Since this annular gap forms an empty cavity, in which the winding ends or connecting conductors are arranged, it is possible there, when a plurality of wire windings are provided, to connect these to one another in the area of this annular gap or to provide the winding ends of these wire windings with respective separate connecting conductors and to lead these radially to the outside through the annular gap.

According to the invention, a winding support may be provided with a plurality of heating wire windings that are each connected to separate connecting conductors.

The fact that this annular gap is closed towards the outside by means of a cover is advantageous in the sense that it is possible as a result to fill the cavity present in the area of the annular gap with a pourable sealing compound or an insulating compound and optionally also to compact it.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENTS

Figure 2:
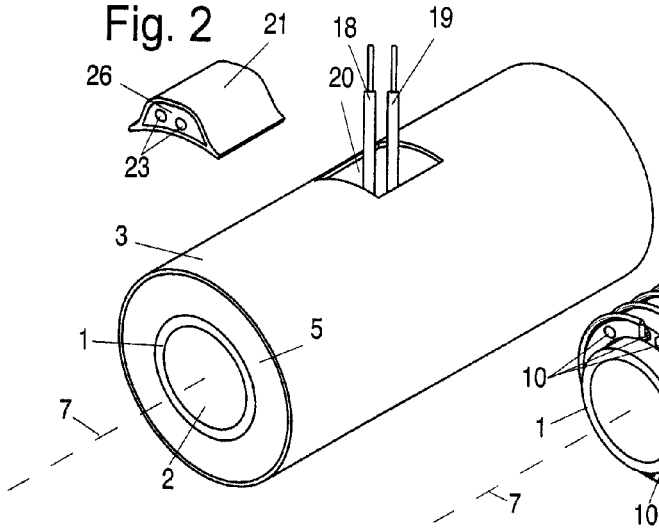
FIG. 2 is a perspective view of the cartridge type heater according to FIG. 1 showing the cover of the opening of the outer metal jacket in a removed state.

Referring to the drawings in particular, The cartridge type heater, which will be described below in a plurality of embodiments, is used to heat plastic injection molding nozzles.

It has the following features in all embodiments:

An inner metal jacket 1, which has the shape of a cylindrical tube, is provided with a central fitting hole 2. This fitting hole 2 is used to receive a cylindrical body to be heated, namely, a plastic injection molding nozzle of an injection mold, in a gap-free manner. An outer metal jacket 3, which is likewise designed as a cylindrical tube and which concentrically surrounds the inner metal jacket 1 at a radially spaced location and which forms an annular chamber 4 with the inner metal jacket 1, is provided concentrically to the inner metal jacket 1.

Figure 15:
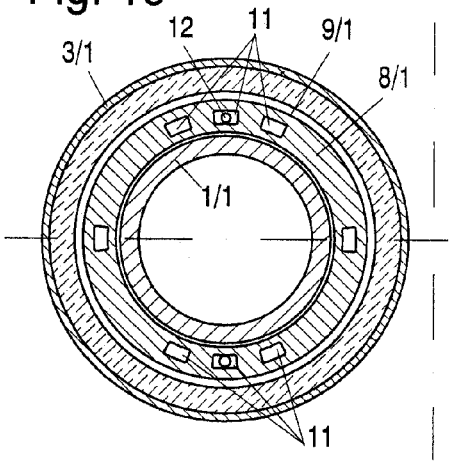
FIG. 15 is a cross sectional view taken along line XV-XV of FIG. 14.

This annular chamber 4 is closed at both front-side ends by metallic ring disks 5 and 6. A winding support 8 consisting of a ceramic mass or a metal oxide, on the circumference of which at least one heating wire winding 9 is wound, is seated in the annular chamber 4 on the inner metal jacket. The cylindrical wall of the winding support 8 is provided with a plurality of axially parallel holes 10 or ducts 11 (FIG. 15), which are provided for receiving the ends 12 and 13 of a heating wire winding 9 and/or for receiving the connecting conductors 18 and 19 connected to the winding ends 12, 13.

The above-mentioned holes 10 and ducts 11 differ only by their cross-sectional shapes. While holes 10 usually have a round cross section, ducts 11 may have any other desired cross-sectional shape, for example, a rectangular or oval cross-sectional shape. They have the same function within the framework of the present invention.

These holes 10 and ducts 11 may also be used to connect a plurality of heating wire windings 9, 9/1 or 9/2, which are provided together on a winding support 8 or on a plurality of winding supports 8/1, 8/2, 8/3 arranged coaxially with one another on the inner metal jacket 1, for example, with the use of auxiliary wires 14, or to connect these to separate connecting wires.

The annular chamber 4 is filled with a compacted insulating compound, for example, MgO (magnesia), in which the heating wire winding is embedded.

Figure 1:
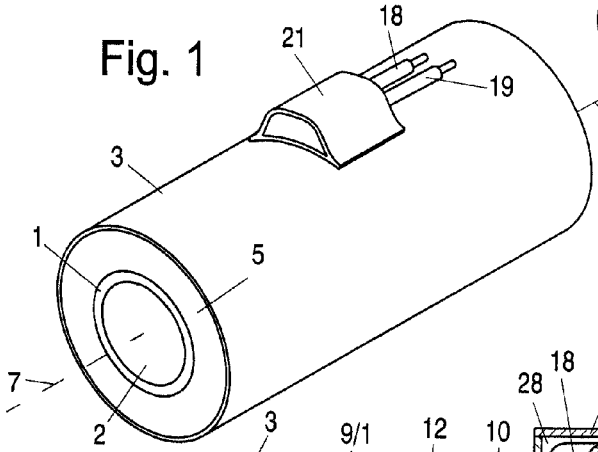
FIG. 1 is a perspective view of a cartridge type heater.
Figure 4:
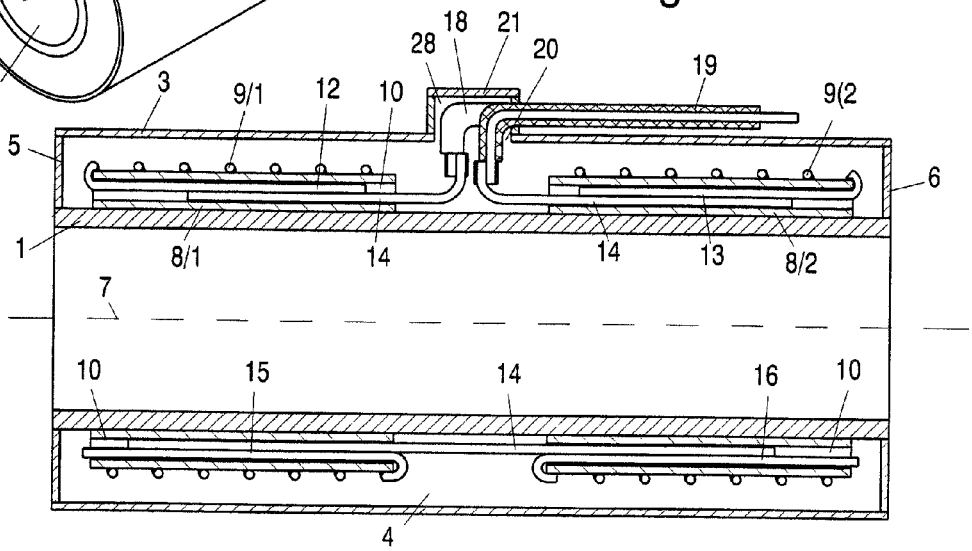
FIG. 4 is a cross sectional view of the cartridge type heater according to FIGS. 1 through 3.
Figure 6:
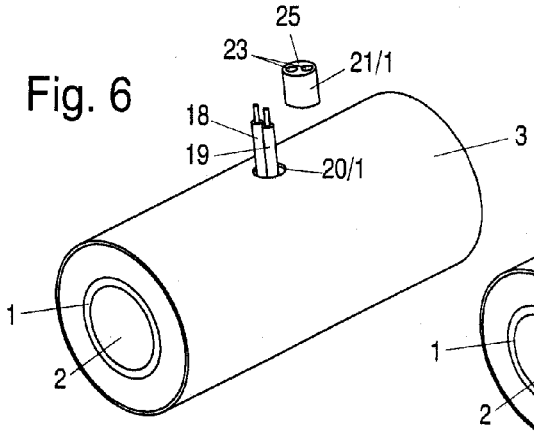
FIG. 6 is a perspective view of the cartridge type heater according to FIG. 5 with the cover removed from the opening.

As can be best recognized from FIGS. 1, 2 and 4, both the inner metal jacket 1 and the outer metal jacket 3 comprise a one-piece pipe each in this exemplary embodiment. The outer metal jacket 3 has, approximately in its longitudinal center, a rectangular opening 20, through which the two connecting conductors 18 and 19 are at first led out radially and are bent off at right angles in the axial direction outside the outer metal jacket 3. A cap-like cover 21 designed as a hollow body is provided for covering and for closing this opening 20. Two holes 23 are provided for leading through the two connecting conductors 18 and 19 in a lateral front wall 26 of this cover 21.

The cavity 28 located in the cover 21 is also filled with the insulating compound as the annular chamber 4 and optionally compacted.

Figure 3:
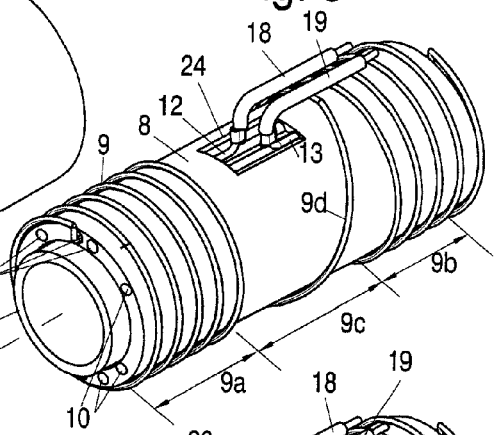
FIG. 3 is a perspective view of the cartridge type heater according to FIG. 1 without the outer metal jacket.

In the exemplary embodiment according to FIG. 3, the inner metal jacket 1 having a one-piece design is provided with a likewise one-piece winding support 8, which extends over the entire axial length and in the end areas of which two tightly wound winding sections 9*a* and 9*b* are arranged, while the axial middle area 9*c* is provided with a connection winding 9*d* only. In this one-piece embodiment of the winding support, the latter is provided in the area of the opening 20 with a rectangular recess 24, which exposes the holes 10 in this area, so that the ends 12 and 13 of the heating wire winding, which are led into this recess 24 through the holes 10 from the front side, can be bent radially outwardly and be connected, for example, to the connecting conductors 18 and 19.

Figure 3A:
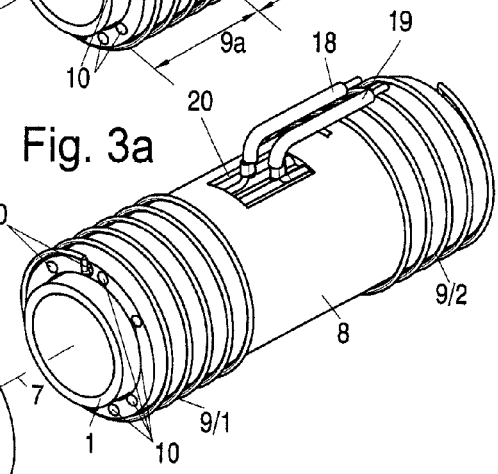
FIG. 3*a* is a perspective view of the cartridge type heater according to FIG. 1 without the outer metal jacket but with two separate heating wire windings on a common winding support.

One variant of this is shown in FIG. 3*a*. Two separate windings 9/1 and 9/2, which may be connected to one another in a series connection or in a parallel connection and may be connected to the common connecting conductors 18, 19, are arranged on the common winding support 8 according to the embodiment.

In the embodiment according to FIG. 4, which otherwise has the same outside appearance, two separate winding supports 8/1 and 8/2 with respective separate heating wire windings 9/1 and 9/2, which are located at an axial distance a from one another in the area of the opening 20 but extend into the vicinity of the front-side ring disks 5 and 6, are arranged within the annular chamber 4 on both sides of the opening 20.

In the exemplary embodiment shown in FIG. 4, these two windings 9/1 and 9/2 are connected in series by an auxiliary wire 14, which connects two ends 15 and 16 of the winding 9/1, on the one hand, and of the winding 9/2, on the other hand, to one another in a contacting manner. The respective other ends 12 and 13 are connected each by the auxiliary wires 14 to the connecting conductors 18 and 19 in a contacting manner.

As can be recognized from the views in FIGS. 1 through 4, a feature essential for the present invention is that the connecting conductors 18, 19, connected to the ends 12 and 13 of the at least one heating wire winding 9, and/or the ends of the at least one heating wire winding are led radially to the outside through an opening 20 of the outer metal jacket 3 in an axial area 9*c* located away from the two axial ends of the annular chamber 4 and located between two heating wire windings 9/1, 9/2 or two winding sections 9*a* and 9*b* of the same heating wire winding 9.

Figure 5:
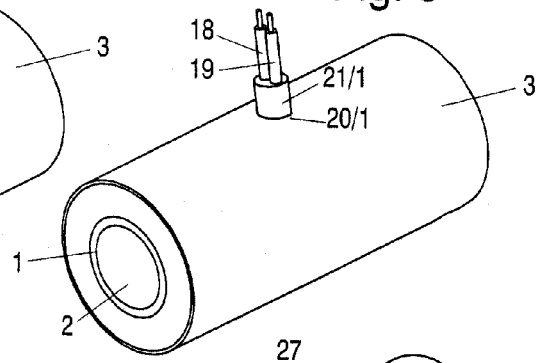
FIG. 5 is a perspective view of a cartridge type heater with a cylindrical cover and connecting conductors led radially out of same.

FIGS. 6 through 10 show a cartridge type heater, whose outer metal jackets 3 have different openings 20/1 compared to the embodiment according to FIGS. 1 through 4. These openings 20/1 have a round cross section and they are also provided with different covers 21/1 and 21/2, respectively. In the embodiment according to FIGS. 5 and 6, the outer metal jacket 3 has a round opening 20/1, which is provided with a cylindrical cover 21/1. The upper front surface of this cover 21/1 is closed by a disk 25, in which two holes 23 are provided for leading through the connecting conductors 18, 19.

Figure 5A:
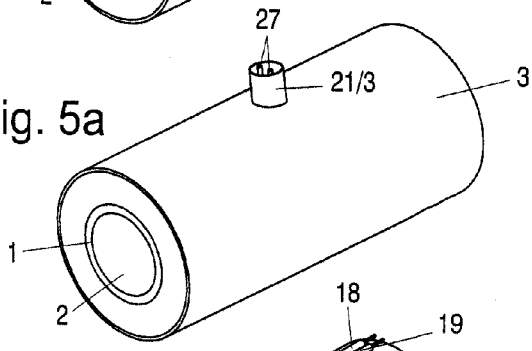
FIG. 5*a* is a perspective view of a cartridge type heater with a cover designed as a connector plug.

The cylindrical cover 21/1 is replaced by a connector plug 21/3 in the embodiment according to FIG. 5*a*.

Figure 8:
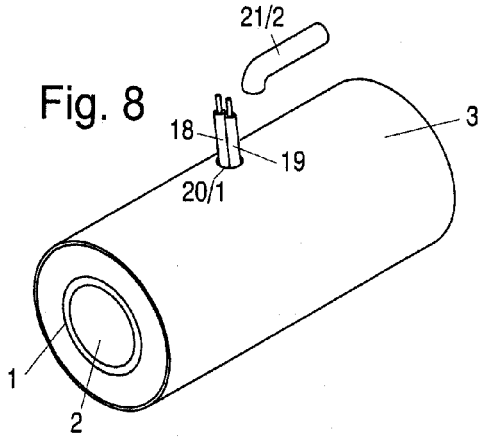
FIG. 8 is a perspective view of the cartridge type heater according to FIG. 7 with the cover of the round opening removed.
Figure 7:
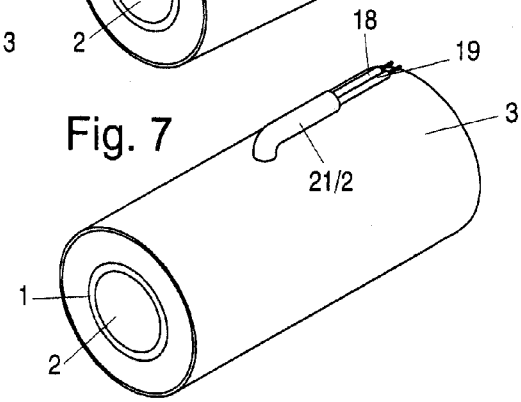
FIG. 7 is a perspective view of a cartridge type heater with a bent tube as a cover for a round opening.

In the embodiment according to FIGS. 7 and 8, which likewise have a round opening 20/1, this opening 20/1 is provided with a cover 21/2, which has the shape of a bent tube, through which the connecting conductors 18 and 19 are led to the outside, for example, in a position in which they are axially parallel, as this is apparent from FIG. 7.

Figure 10:
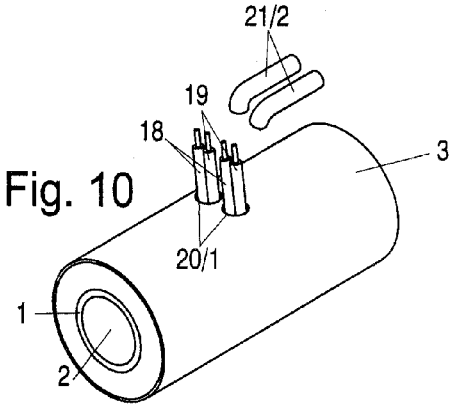
FIG. 10 is a perspective view of the cartridge type heater according to FIG. 9 with the bent tubes as covers for the round openings removed.
Figure 9:
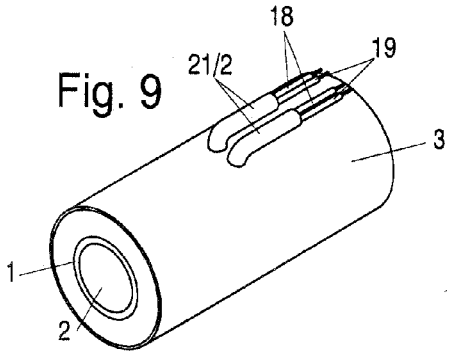
FIG. 9 is a perspective view of a cartridge type heater with two bent tubes as covers for two round openings.

Two round openings 20/1, which are arranged next to each other in the circumferential direction and which are covered, as in the exemplary embodiment according to FIGS. 7 and 8, by covers 21/2, which have the form of a bent tube, are provided in the embodiment according to FIGS. 9 and 10. Two connecting conductor pairs 18 and 19 are provided in this case, which are led to the outside through the openings 20/1 and the covers 21/2 in the manner shown in FIG. 9 in a position in which their axes are located in parallel.

The inner structure of these cartridge type heaters according to FIGS. 5 through 10 can correspond, for example, to that according to FIG. 4. In the embodiment according to FIGS. 9 and 10, it is possible to provide the two heating wire windings 9/1 and 9/2 according to FIG. 4 with separate connecting conductor pairs 18 and 19 each, so that these can be activated independently from each other.

The outer metal jacket 3 has a two-part design in the exemplary embodiments described below, so that it comprises two sections 3/1 and 3/2, which have the same diameter and which form between them an annular gap as an opening 20/2, through which the connecting conductors 18 and 19 can be led radially to the outside.

In the exemplary embodiments 11 through 15, the inner metal jackets 1 also comprises two parts 1/1 and 1/2 each, which join each other on the front side in the middle in the opening 20/2 designed as an annular gap and can also be connected to one another there by welding. It is thus possible to manufacture a left half and a right half of the entire cartridge type heater individually with a wire-wound winding support 12 and 13, respectively, and to fit these together coaxially in the prefabricated state. The two annular chambers 4, which are connected to one another, may be filled with the granular insulating material, e.g., MgO, and compacted, in the already fitted state, and it is possible after the compacting to expose the ends of the heating wire windings 9/1 and 9/2, which ends are led into the opening 20/2, or to expose the heating wires 14 connected to these and, e.g., to connect these to the connecting conductors 18 and 19.

A ring wall 30, which has a larger diameter than the two outer metal jacket sections 3/1 and 3/2, which have equal diameters, is provided as a cover for the opening 20/2 comprising the annular gap, so that there is a radial distance R circumferentially between these. Ring disks 31 and 32, which are tightly connected, e.g., welded, to the ring wall 30 and to the two opposite ends of the outer metal jacket sections 3/1 and 3/2, are provided in the area of this radial distance R. Like the annular chamber 4, the cavity 34 formed when arranging the ring wall 30 and the two ring disks 31 and 32 is subsequently filled with a granular insulating material, e.g., MgO or with a pourable sealing compound, e.g., epoxy resin, silicone rubber, ceramic putty compound or the like and optionally compacted.

To make it possible to lead the connecting conductors 18 and 19 connected to the auxiliary wires 14 or to the ends 12 and 13 out of the opening 20/2, the ring wall 30 is provided with two radial passage openings 23.

Figure 12:
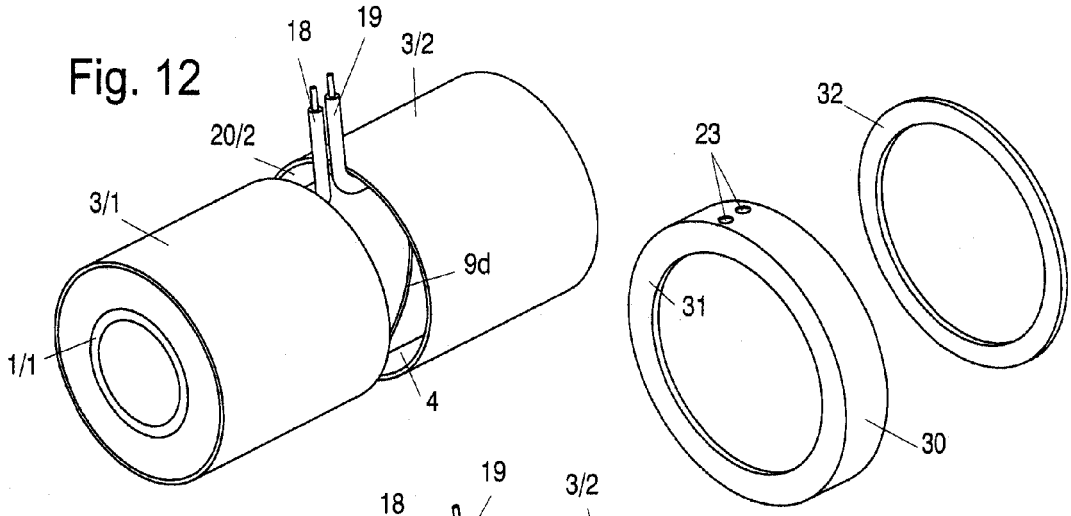
FIG. 12 is a perspective view of a cartridge type heater according to FIG. 11 showing the ring wall in a removed state.
Figure 11:
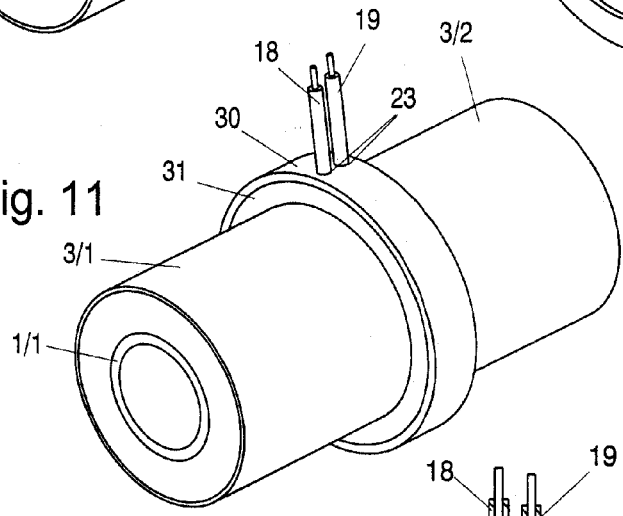
FIG. 11 is a perspective view of another cartridge type heater with a ring wall as a cover of an annular gap-like opening of the outer metal jacket.

As can be recognized from FIG. 12, it is also possible, for example, the make the ring disk 31 integrally in one piece with the ring wall 30 if this is manufactured, for example, as a deep-drawn part and to arrange the second ring disk later in order to closingly bridge over the radial distance R on its side.

Figure 13:
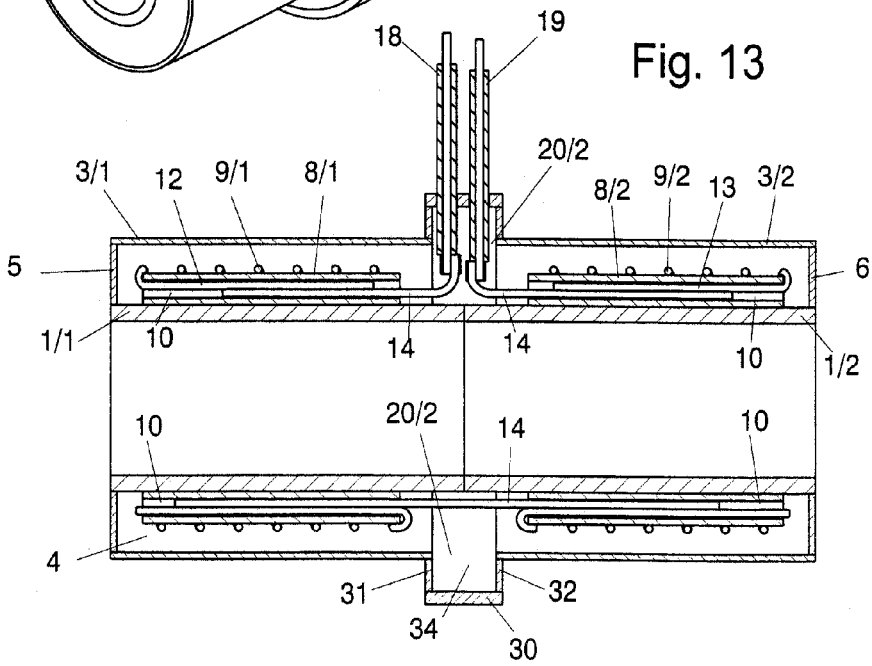
FIG. 13 is a cross sectional view of the cartridge type heater according to FIG. 11.
Figure 14:
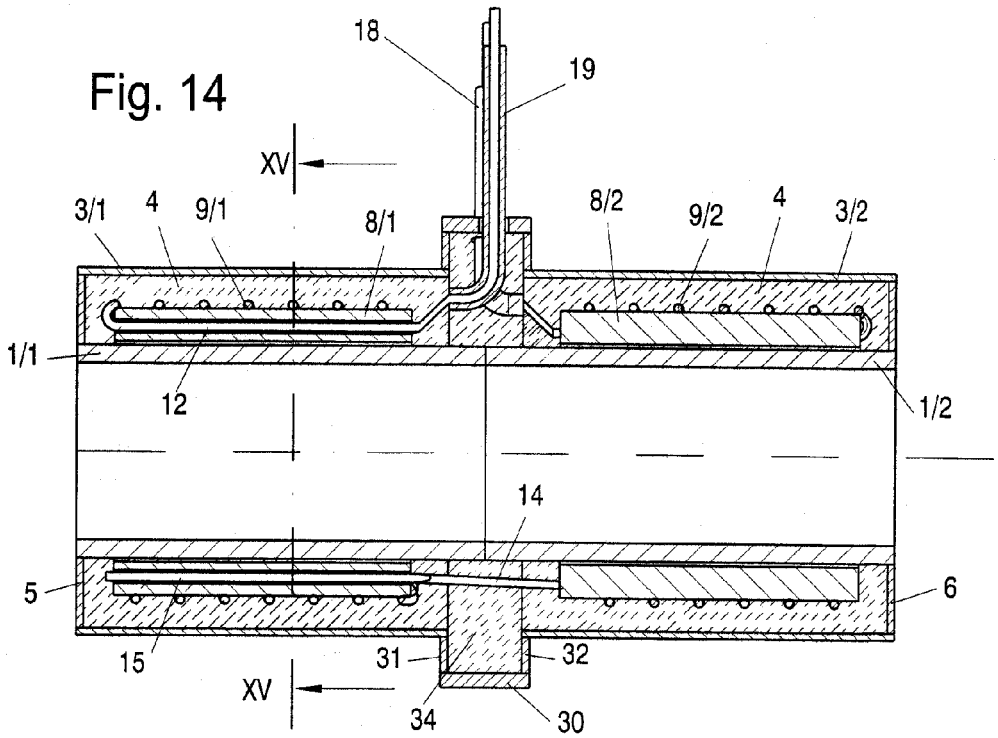
FIG. 14 is an enlarged cross sectional view of another embodiment of the cartridge type heater according to FIG. 11.

As is apparent from FIGS. 13 and 14, there are, in principle, two possibilities of connecting the two windings 9/1 and 9/2 of the two separate winding supports 8/1 and 8/2, They may be connected in parallel, as this is provided in the exemplary embodiment according to FIG. 13, or in series, as this is shown in the exemplary embodiment according to FIG. 14. FIG. 14 also shows how the cavity 34 that is initially present in the area of the opening 20/2 designed as an annular gap is filled with the same granular insulating material as the annular chambers 4, which will then be contiguous and are formed by the two sections 1/1 and 1/2 of the inner metal jacket 1 and by the two sections 3/1 and 3/2 of the outer metal jacket 3.

These annular chambers 4 are closed by the ring disks 5 and 6 on the front side in all embodiments.

FIGS. 16 through 30 show different exemplary embodiments, which have as an opening 20/2 in the outer metal jacket, an annular gap each, whose inner metal jacket 1 is, however, of a one-piece design and extends over the entire length of the cartridge type heater.

Figure 16:
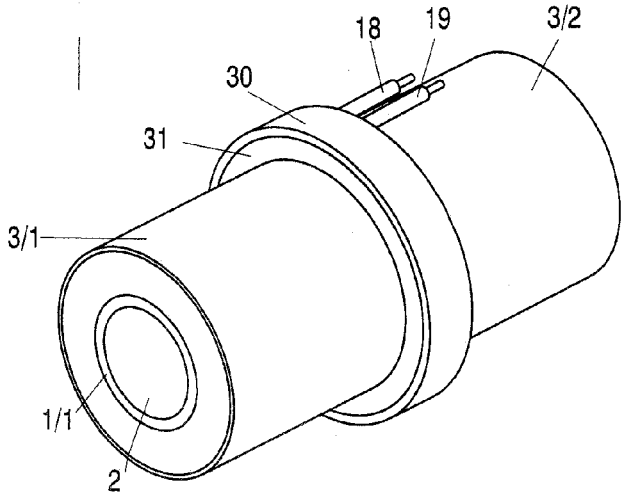
FIG. 16 is a perspective view of another embodiment of the cartridge type heater with a ring wall as a cover, but with the connecting conductors led out axially in parallel.
Figure 17:
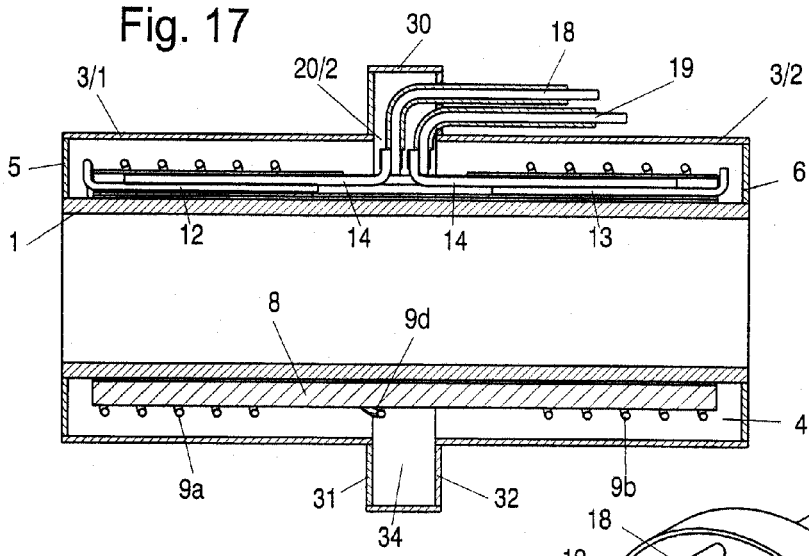
FIG. 17 is an enlarged cross sectional view of the cartridge type heater according to FIG. 16.

As in the exemplary embodiment according to FIG. 3, a winding support 8, which extends essentially over the entire length of the two joined annular chambers 4 and on which a contiguous heating wire winding 9 is arranged, is also provided in the exemplary embodiment according to FIGS. 16 and 17, but the heating wire winding 9 has two tightly wound sections 9*a* and 9*b*, between which the opening 20/1 designed as an annular gap is arranged. These two winding sections 9*a* and 9*b* are connected to one another by one or more winding turns 9*d* of a greater pitch. The winding ends 12 and 13 introduced into a hole 10 of the winding support 8 from the front side are connected to the two connecting conductors 18 and 19 by auxiliary wires 14 in an electrically conductive manner. These two connecting conductors 18 and 19 are led to the outside in this exemplary embodiment as well as in other exemplary embodiments through a ring disk 32 rather than radially through the ring wall 30, as this appears, for example, from FIG. 17.

It is shown in this example that the opening 20/1, through which the connecting conductors 18 and 19 are led to the outside, is arranged between two winding sections 9*a* and 9*b* at a point that is arranged away from the front-side ends of the annular chamber 4 and from the ring disks 5 and 6, which limit the annular chamber 4 on the front side.

This axial distance of the opening 20, 20/1, 20/2 from the two ends of the cartridge type heater, i.e., from the ring disks 5 and 6, may be equal or different.

Figure 18:
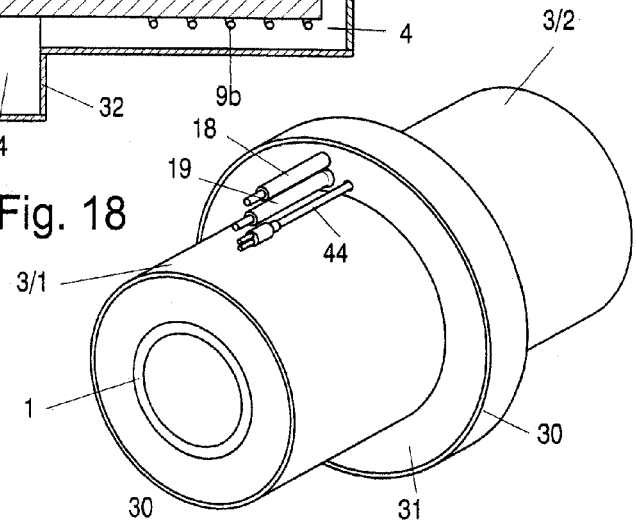
FIG. 18 is a perspective view of a cartridge type heater with a ring wall as a cover.
Figure 19:
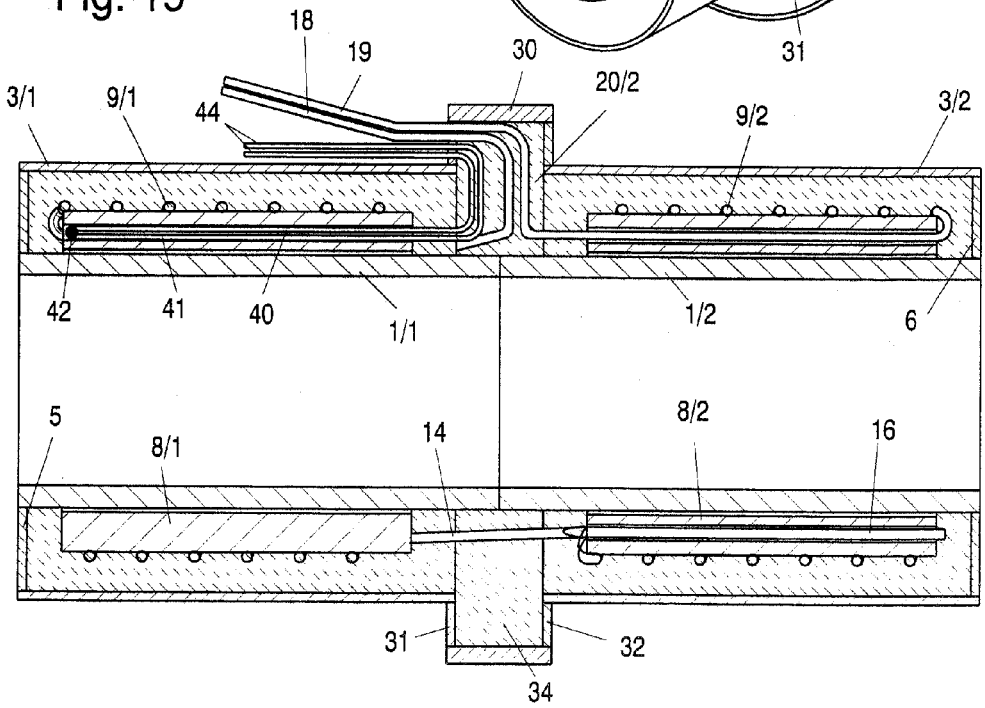
FIG. 19 is an enlarged cross sectional view of the cartridge type heater according to FIG. 18.

The exemplary embodiment according to FIGS. 18 and 19 has essentially the same inner structure as the exemplary embodiment according to FIG. 13. However, a thermocouple 42, which comprises two thermoelectric wires 40 and 41 consisting of different metals and whose terminals 44 are led to the outside through corresponding openings of the ring disk 31, is arranged in a hole 10 of one winding support 8/1. The ring disks 32 are completely closed in this case. The ring wall 30 is provided as a cover for the opening 20/2 designed as an annular gap in this case as well. The structure is otherwise the same as in the exemplary embodiment according to FIG. 13.

FIG. 18, which is a perspective view of the exemplary embodiment according to FIG. 19, shows how the connecting conductors 18 and 19 as well as the terminals of the thermocouple 42 are led to the outside.

Figure 20:
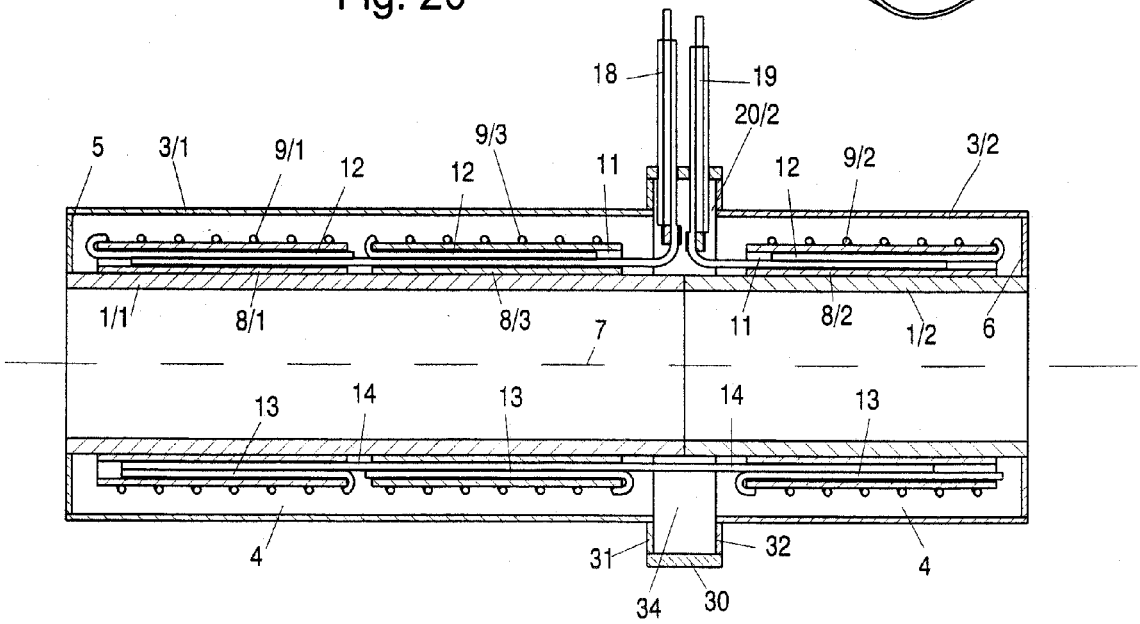
FIG. 20 is a cross sectional view of another embodiment of the cartridge type heater.
Figure 25:
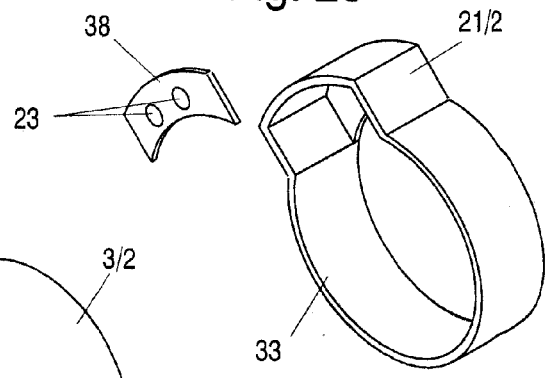
FIG. 25 is a perspective view of the cuff-like cover according to FIG. 24 as an individual part.
Figure 24:
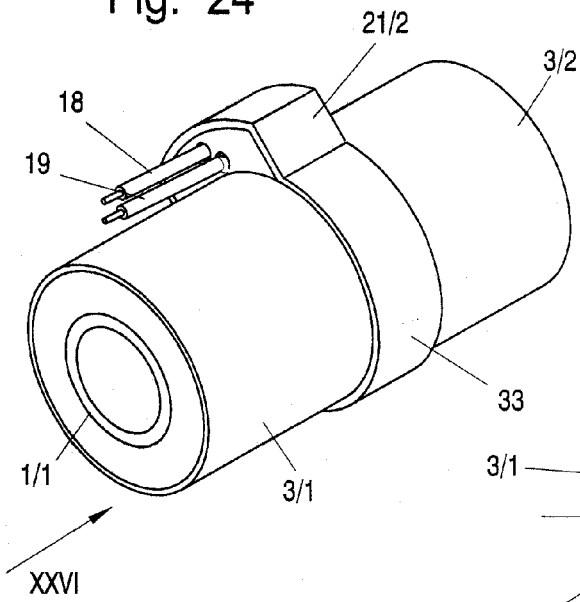
FIG. 24 is a perspective view of another embodiment of the cartridge type heater with another, cuff-like cover for the opening of the outer metal jacket, which the opening is designed as an annular gap.
Figure 26:
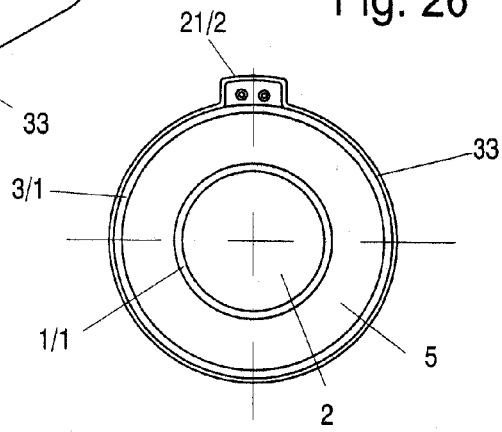
FIG. 26 is a front view taken in the direction of XXVI from FIG. 24.

Three winding supports 8/1, 8/2 and 8/3, which are provided with separate heating wire windings 9/1, 9/2 and 9/3 each, are arranged on a one-piece inner metal jacket 1 in the exemplary embodiment according to FIG. 20, which is shown in a sectional view. The opening 20/1, which is designed as an annular gap in this embodiment as well, is located between the two winding supports 8/2 and 8/3 and thus also between the two windings 9/2 and 9/3. This opening 20/1 is closed by the ring wall 30 and the two ring disks 31 and 32 in this case as well. The ring wall 30 has two radial holes 23, through which the two connecting conductors 18 and 19 are led radially to the outside. While the ends 13 of all three heating wire windings 9/1, 9/2 and 9/3, which ends are located in the lower hole 10, are connected to one another by an auxiliary wire 14 and these windings are thus connected in parallel, the two ends 12 of the windings 9/1 and 9/3, which ends are located in the upper hole 10, are connected by an auxiliary wire 14 together with the connecting conductor 18.

The other auxiliary wire 14 is led into an upper hole 10 of the winding support 8/2, where it contacts the upper winding end 12 of the heating wire winding 9/2 and connects same to the connecting conductor 19.

Figure 22:
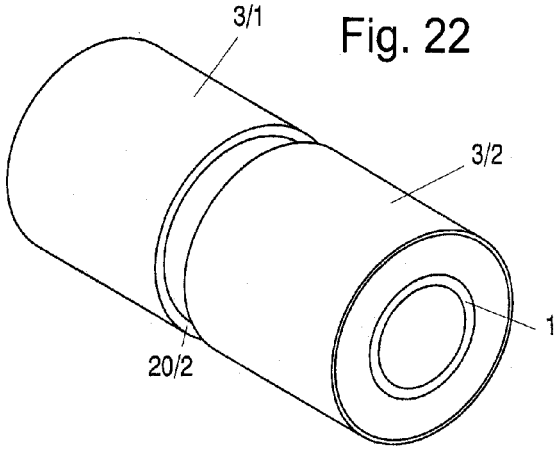
FIG. 22 is a perspective view of the cartridge type heater according to FIG. 21 without cover of the opening of the outer metal jacket, which the opening has the shape of an annular gap.
Figure 23:
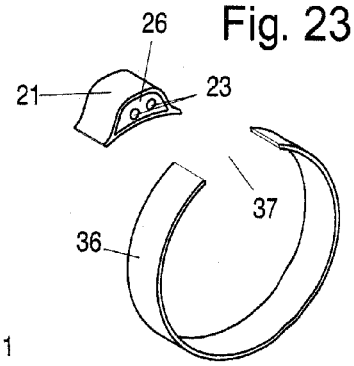
FIG. 23 is a perspective view of a ring wall and an additional cover for the annular gap according to FIG. 22.
Figure 21:
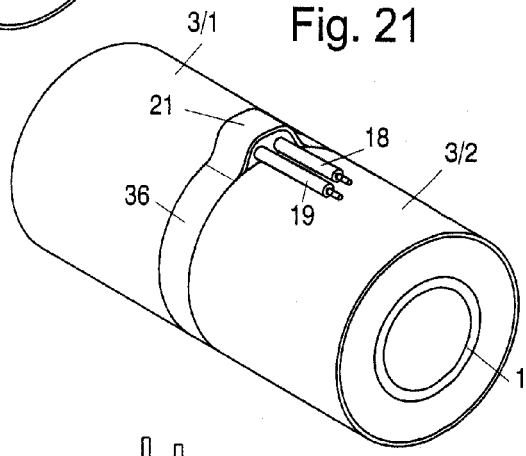
FIG. 21 is a perspective view of another embodiment of the cartridge type heater with another cover.

FIGS. 21 through 23 show an embodiment in which the opening 20/2 designed as an annular gap is closed for the most part by a ring 36 bridging over the annular gap between the two outer metal jacket sections 3/1 and 3/2. This ring 36 has an interruption 37, into which a cover 21 is fittingly inserted. As in FIG. 1, two connecting conductors 18 and 19 are led through this cover 21 to the outside in an axially parallel manner through holes 23 in a front wall 26.

In the exemplary embodiment shown in FIGS. 24 through 27, whose inner structure corresponds to that of FIG. 17, the opening 20/1 designed as an annular gap is closed with a ring wall, which is directly and connectingly in contact with the two outer metal jacket sections 3/1 and 3/2. This ring wall 33 is provided with a hood-like expansion 21/2, which projects radially to the outside and whose function corresponds to that of the cover 21. This hood-like expansion 21/2 is closed on the front side by wall elements 38 and 39. The wall element 38 has two holes 23, through which the connecting conductors 18 and 19 can be led to the outside. The cavity 34 in the area of the annular gap-like opening 20/1 and of the expansion 21/2 is filled with granular MgO or with a pourable sealing compound and optionally compacted in this embodiment as well.

Figure 27:
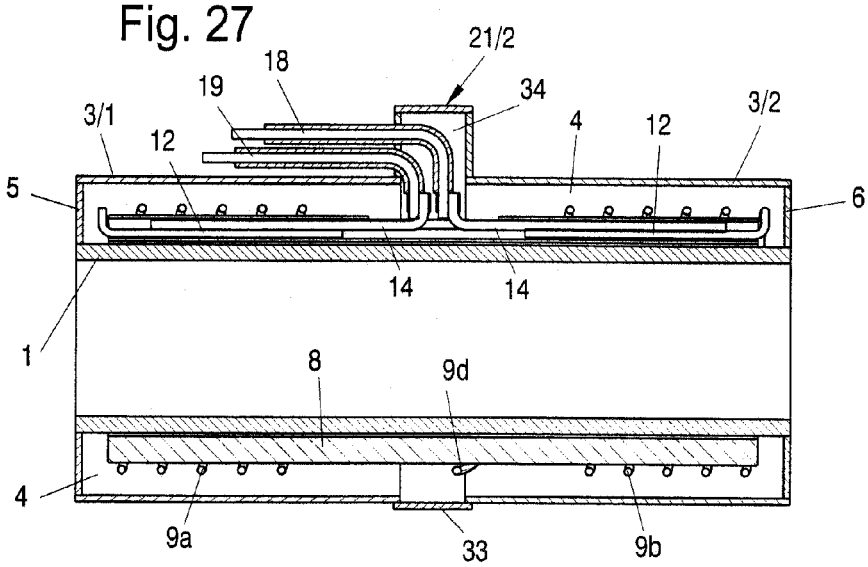
FIG. 27 is a cross sectional view of the cartridge type heater according to FIG. 24.

The inner structure of this embodiment, shown as a sectional view in FIG. 27, otherwise corresponds to that in FIG. 17.

Figure 28:
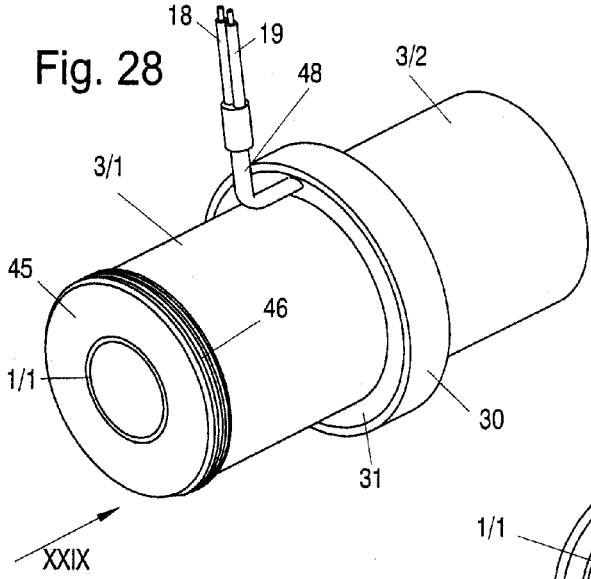
FIG. 28 is a perspective view of a cartridge type heater with a ring wall and with external threads on a front side.
Figure 29:
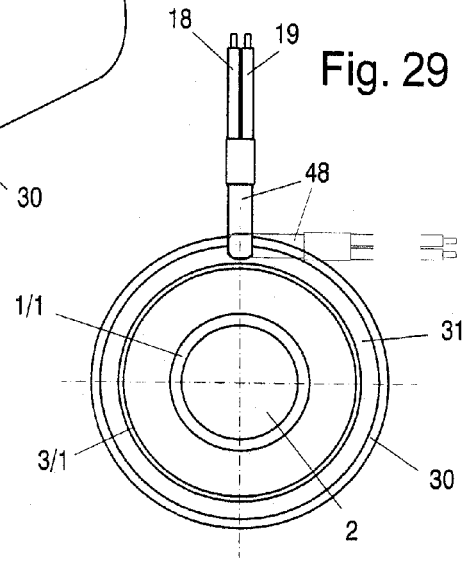
FIG. 29 is a front view taken in the direction of XXIX from FIG. 28.

FIGS. 28 and 29 show an exemplary embodiment in which a metal ring 45 with an external thread 46 is arranged concentrically at one end of the cartridge type heater. It is possible by means of this external thread 46 to fasten the cartridge type heater on a cylindrical injection molding nozzle, for example, by means of a so-called union nut, in a simple manner.

The winding ends of the heating wire winding or heating wire windings, which heating wire windings are arranged in the interior of the cartridge type heater, are connected to the connecting conductors 18 and 18 in the above-described manner via auxiliary wires and by means of a mineral-insulated two-wire line 48 in this cartridge type heater, which is likewise provided with a ring wall 30 and with a ring disk 31.

Mineral-insulated lines comprise, as a rule, a metal jacket, in which electric conductor wires are embedded in a highly compacted granular mineral insulating material, These mineral-insulated lines, which may be of a single-wire or multi-wire design, have a high temperature stability. They are therefore especially suitable and can be especially recommended for cartridge type heaters of the type being described here, because temperatures that are not withstood by the plastic insulations of usual electric lines may occur in them and in the environment in which they are installed. It is therefore useful to generally use such mineral-insulated lines as connecting conductors 18 and 19 in cartridge type heaters of the type of this class.

Figure 30:
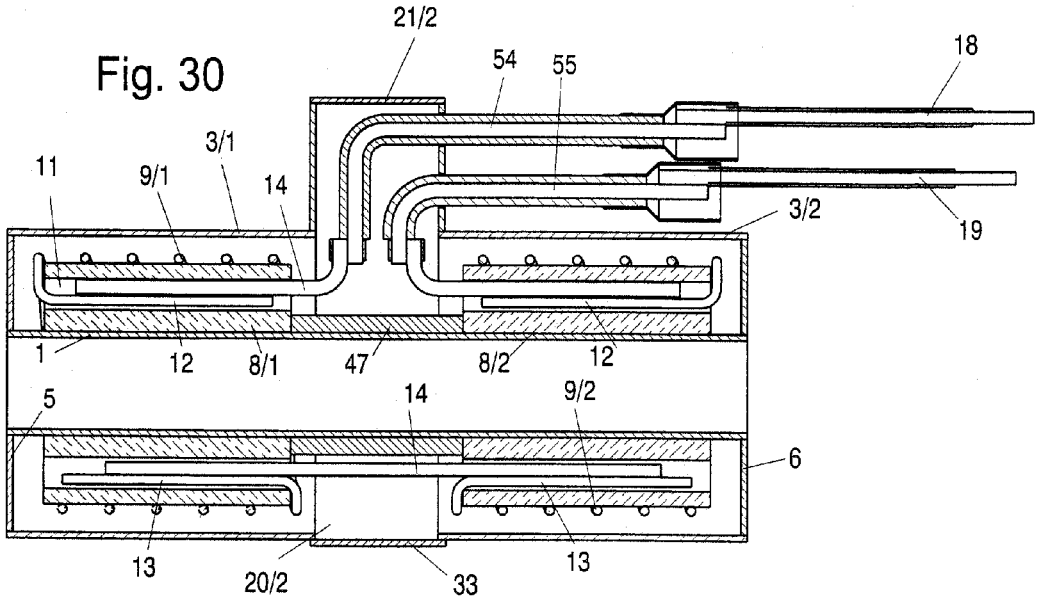
FIG. 30 is a cross sectional view of another embodiment of the cartridge type heater.

Finally, FIG. 30 also shows a sectional view of an embodiment with an annular gap-like opening 20/1, which is closed with a ring wall 33, which has the radial expansion 21/2. The two winding supports 8/1 and 8/2, which are arranged on both sides of the opening 20/1, are separated from each other by a spacer ring 47 in this embodiment. This spacer ring 47 has an external diameter that is selected to be such that the holes 10 of the two winding supports 8/1 and 8/2, respectively, lie freely on the side facing the opening 20/1 and are thus freely accessible for the insertion of winding ends or conductor wires 14. The windings 9/1 and 9/2 of the two winding supports 8/1 and 8/2 are connected in series by means of an auxiliary wire 14, which connects the two winding ends 15 and 16 to one another, in this embodiment as well.

The respective other winding ends 12 and 13 are connected by auxiliary wires 14 to the conductors 54 and 55 of two mineral-insulated lines 56 and 57, to which the connecting conductors 18 and 19 are connected.

While specific embodiments of the invention have been shown and described in detail to illustrate the application of the principles of the invention, it will be understood that the invention may be embodied otherwise without departing from such principles.

What is claimed is:

1. An electric cartridge type heater, comprising:

an inner metal jacket defining a continuous central fitting hole for receiving a cylindrical body in a gap-free manner;

an outer metal jacket surrounding said inner metal jacket, said inner metal jacket and said outer metal jacket defining an annular chamber such that said annular chamber is located between said inner metal jacket and said outer metal jacket, said annular chamber being closed on a front side;

a hollow cylindrical coil form having a cylinder wall with a circumferential surface, said cylinder wall defining a plurality of axially parallel holes;

a heating conductor in the form of a first heating wire winding and a second heating wire winding, said first heating wire winding and said second heating wire winding being wound about said circumferential surface of said hollow cylindrical coil form, said hollow cylindrical coil form with said first heating wire winding and said second heating wire winding being located within said annular chamber, each hole of said cylinder wall receiving one end of said first heating wire winding or one end of said second heating wire winding;

electric connecting conductors, each electric connecting conductor receiving another end of said first heating wire winding or another end of said second heating wire winding, said outer metal jacket having an outer metal jacket surface defining a wire opening located at a spaced location from each axial end of said annular chamber and between said first heating wire winding and said second heating wire winding, said electric connecting conductors radially extending through said wire opening to a position located outside of said outer metal jacket; and an insulating compound consisting essentially of a ceramic mass or a metal oxide, said insulating compound filling said annular chamber and surrounding said hollow cylindrical coil form such that said hollow cylindrical coil form, said first heating wire winding, said second heating wire winding and said inner metal jacket are radially compacted via said insulating compound.

2. An electric cartridge type heater in accordance with claim 1, wherein at least one of said holes of said hollow coil form is in communication with said wire opening in an axial area of said wire opening, one said winding end of said first heat wire winding or said second heat wire winding and/or one of said connecting conductors extending through said at least one hole to said wire opening.

3. An electric cartridge type heater in accordance with claim 1, wherein said wire opening has a cover arranged on said outer metal jacket surface for receiving said connecting conductors extending from said wire opening.

4. An electric cartridge type heater in accordance with claim 3, wherein said wire opening is limited axially and in the circumferential direction.

5. An electric cartridge type heater in accordance with claim 4, wherein said cover is a connector plug having at least two contact pins, one contact pin being connected to one end of said first heating wire winding, another contact pin being connected to one end of said second heating wire winding.

6. An electric cartridge type heater in accordance with claim 4, wherein said cover comprises a hollow body surrounding said wire opening, said hollow body defining at least one passage opening for receiving one of said connecting conductors, said passage opening extending at least approximately axially in parallel to a longitudinal axis of said hollow cylindrical coil form.

7. An electric cartridge type heater in accordance with claim 4, wherein said cover comprises a bent tube with a radial tube section and an axially parallel tube section.

8. An electric cartridge type heater in accordance with claim 3, wherein said cover comprises an essentially radially extending tube section.

9. An electric cartridge type heater in accordance with claim 1, wherein said outer metal jacket comprises a first jacket section having a first jacket section front side and a second jacket section having a second jacket section front side, said first jacket section being coaxial with said second jacket section, said first jacket section being disposed at a spaced location from said second jacket section such that said first jacket section front side and said second jacket section front side define an annular gap, said annular gap being radially surrounded by a ring wall, said ring wall defining at least one radial passage opening for receiving one of said connecting conductors.

10. An electric cartridge type heater in accordance with claim 9, further comprising a first circumferential ring disk and a second circumferential ring disk, wherein said ring wall is located at a spaced location from said first jacket section and said second jacket section, said first circumferential ring disk being located on one side of said ring wall and said circumferential ring disk being located on another side of said ring wall such that said first circumferential ring disk and said second circumferential ring disk close the space between said ring wall and said first jacket section and said second jacket section.

11. An electric cartridge type heater in accordance with claim 10, wherein at least one of said circumferential ring disk defines at least one conductor passage opening for receiving one of said connecting conductors.

12. An electric cartridge type heater in accordance with claim 10, wherein said heating conductor includes a third heating wire winding, each end of said first heating wire winding, said second heating wire winding and said third heating wire winding being connected in a cavity enclosed by said ring wall.

13. An electric cartridge type heater in accordance with claim 12, further comprising a pourable sealing compound including one or more of epoxy resin, silicone rubber and ceramic putty compound, wherein said cavity enclosed by said ring wall is filled with said pourable sealing compound.

14. An electric cartridge type heater in accordance with claim 13, wherein said cavity enclosed by said ring wall is filled with the same insulating compound as said annular chamber containing said heating wire windings.

15. An electric cartridge type heater in accordance with claim 1, further comprising a first metallic disk connected to one side of said inner metal jacket and said outer metal jacket and a second metallic disk connected to another side of said inner metal jacket and said outer metal jacket, said first metallic disk and said second metallic disk enclosing said annular chamber.

16. An electric cartridge type heater in accordance with claim 1, wherein said first heating wire winding is connected to one connecting conductor and said second heating wire winding is connected to another connecting conductor.

17. An electric cartridge type heater in accordance with claim 1, wherein said first heating wire winding is wound about a first circumferential portion of said hollow cylindrical coil form, said second heating wire winding being wound about a second circumferential portion of said hollow cylindrical coil form, said first portion of said hollow cylindrical coil form with said first heating wire winding being coaxial with said second portion of said hollow cylindrical coil form with said second heating wire winding, said first portion of said hollow cylindrical coil form being disposed at a spaced location from said second portion of said hollow cylindrical coil form such that said first portion of said hollow cylindrical coil form is opposite said second portion of said hollow cylindrical coil form in an axial area of said wire opening, said inner metal jacket extending the entire length of the cartridge type heater, said heating wire windings being connected in series or in parallel, one end of said first heating wire winding being connected to one end of said second heating wire winding, said end of said first heating wire winding and said end of said second hearing wire winding having a common connecting conductor.

18. An electric cartridge type heater in accordance with claim 1, further comprising an auxiliary wire extending through one of said holes of said hollow cylindrical coil form and connected to one of said connecting conductors, wherein one end of said first heating wire winding and one end of said second heating wire winding are connected to said auxiliary wire, said first heating wire winding and said second hearing wire winding comprising a round wire.

19. An electric cartridge type heater in accordance with claim 18, wherein each connecting conductor comprises mineral-insulated lines having conductor wires directly connected to one end of said first heating wire winding or one end of said second heating wire winding or connected to said first heating wire winding or said second heating wire winding via said auxiliary wire.

20. An electric cartridge type heater in accordance with claim 1, wherein said first heating wire winding and said second heating wire winding are wound about said hollow cylindrical coil form such that each winding of wire is at a distance that is different than another winding of wire over the length of said hollow cylindrical coil form.

21. An electric cartridge type heater in accordance claim 1, further comprising a metal ring having an external thread fastened to a front-side free end of said outer metal jacket.

22. An electric cartridge type heater in accordance with claim 1, further comprising a spacer ring arranged between a first portion of said hollow cylindrical coil form and a second portion of said hollow cylindrical coil form in an area of said wire opening of said outer metal jacket, said first portion of said hollow cylindrical coil form being arranged coaxial with said second portion of said hollow cylindrical coil form within said annular chamber, said first portion of said hollow cylindrical coil form and said second portion of said hollow cylindrical coil form having axial holes, said spacer ring maintaining said first portion of said hollow cylindrical coil form at a spaced location from said second portion of said hollow cylindrical coil form such that said axial holes of said first portion and said second portion are exposed.

23. An electric cartridge type heater in accordance with claim 1, further comprising thermoelectric wires arranged in at least one hole of said hollow cylindrical coil form, each end of one thermoelectric wire being connected to another end of another thermoelectric wire to form a thermocouple.

24. An electric cartridge type heater, comprising:

an inner metal sleeve defining a continuous central fitting space for receiving a plastic injection molding nozzle in a gap-free manner;

an outer metal sleeve surrounding said inner metal sleeve;

a first metallic disk engaging said inner metal sleeve and said outer metal sleeve at a front side thereof;

a second metallic disk engaging said inner metal sleeve and said outer metal sleeve at a rear side thereof, said first metallic disk, said second metallic disk, said inner metal sleeve and said outer metal sleeve defining an annular chamber;

a cylindrical winding support in contact with said inner metal sleeve, said cylindrical winding support having a first cylinder wall with a first circumferential surface and a second cylinder wall with a second circumferential surface, said first cylinder wall defining a plurality of first axially parallel holes, said second cylinder wall defining a plurality of second axially parallel holes;

a first heating wire winding wound about said first circumferential surface of said cylindrical winding support;

a second heating wire winding wound about said second circumferential surface of said cylindrical winding support, said first heating wire winding and said second heating wire winding defining a heat conductor, said cylindrical winding support with said first heating wire winding and said second heating wire winding connected thereto being located within said annular chamber, each first hole of said first cylinder wall receiving one end of said first heating wire winding, each second hole of said second cylinder wall receiving one end of said second heating wire winding;

a first electric connecting conductor receiving another end of said first heating wire winding;

a second electric connecting conductor receiving another end of said second heating wire winding, said outer metal jacket having an outer metal jacket surface defining a conductor opening located at a spaced location from said first metallic disk and said second metallic disk, said conductor opening corresponding to an area of said cylindrical winding support that is located between said first heating wire winding and said second heating wire winding, said first electric connecting conductor and said second electric connecting conductor extending radially from a position within said annular chamber to a position located outside said outer metal sleeve via said conductor opening;

an insulating compound comprising at least one of a ceramic mass and metal oxide, said insulating compound being located within said annular chamber such that said insulating compound surrounds said cylindrical winding support to radially compress said cylindrical support, said first heating wire winding, said second heating wire winding and said inner metal jacket.

25. An electric cartridge type heater according to claim 24, wherein said first heating wire winding is connected to said second heating wire winding.

* * * * *